US006447616B1

(12) United States Patent
Cote et al.

(10) Patent No.: US 6,447,616 B1
(45) **Date of Patent: *Sep. 10, 2002**

(54) METHOD FOR TREATING BRASS

(75) Inventors: Edward L. Cote, Novi, MI (US); Andrew D. Wenzel, Mount Horeb, WI (US)

(73) Assignee: The Ford Meter Box Company, Wabash, IN (US)

( * ) Notice: Subject to any disclaimer, the term of this patent is extended or adjusted under 35 U.S.C. 154(b) by 58 days.

This patent is subject to a terminal disclaimer.

(21) Appl. No.: 09/652,799

(22) Filed: Aug. 31, 2000

(51) Int. Cl.[7] ..... C23G 1/02

(52) U.S. Cl. ..... 134/3; 134/1; 134/2; 134/22.1; 134/22.13; 134/22.14; 134/22.19; 134/26; 134/28; 134/29; 134/36; 134/41; 134/42; 510/254; 510/375; 510/378; 510/435; 510/480; 510/488; 510/501

(58) Field of Search ..... 134/1, 2, 3, 22.1, 134/22.13, 22.14, 22.19, 26, 28, 29, 36, 41, 42; 510/254, 375, 378, 435, 488, 480, 501

(56) References Cited

U.S. PATENT DOCUMENTS

| | | | | |
|---|---|---|---|---|
| 4,048,121 | A | | 9/1977 | Chang |
| 4,333,785 | A | | 6/1982 | Erickson |
| 4,541,945 | A | | 9/1985 | Anderson et al. |
| 4,664,811 | A | | 5/1987 | Operhofer |
| 4,789,406 | A | | 12/1988 | Holder et al. |
| 4,810,405 | A | | 3/1989 | Waller et al. |
| 5,015,298 | A | | 5/1991 | Arrington |
| 5,454,876 | A | | 10/1995 | Downey |
| 5,468,303 | A | | 11/1995 | Thomas, Sr. |
| 5,532,094 | A | | 7/1996 | Arimura et al. |
| 5,544,859 | A | | 8/1996 | Coltrinari et al. |
| 5,601,658 | A | | 2/1997 | Marinas et al. |
| 5,632,825 | A | | 5/1997 | Coltrinari et al. |
| 5,707,421 | A | | 1/1998 | Joe |
| 5,863,345 | A | | 1/1999 | Talley |
| 5,904,783 | A | | 5/1999 | Hager et al. |
| 5,919,519 | A | | 7/1999 | Tallis |
| 5,955,410 | A | | 9/1999 | Dingess et al. |
| 5,958,257 | A | | 9/1999 | Regelbrugge et al. |
| 6,197,210 | B1 | * | 3/2001 | Myerson ..... 134/3 |
| 2002/0043271 | A1 | * | 4/2002 | Cole et al. |

FOREIGN PATENT DOCUMENTS

| | | | |
|---|---|---|---|
| JP | 77021457 | * | 6/1977 |
| WO | WO 97/06313 | | 2/1997 |
| WO | WO98/30510 | * | 7/1998 |
| WO | WO98/30733 | * | 7/1998 |

OTHER PUBLICATIONS

*Stellar Solutions Product Information*, Stellar Solutions, 1000 N. Harrison Street, Algonquin, IL 60102–2314.

Mark Conway, Smallwood Holoman, Ladel Jones, Ray Leenhouts, Gerald Williamson; "Selecting and Using Chelating Agents," *Chemical Engineering*; Mar., 1999; pp. 86–90.

*CitriSurf "The Wave of the Future,"* (Product Information), Stellar Solutions, 1000 N. Harrison Street, Algonquin, IL 60102–2314.

*Ecowave®*, "General Presentation/Acquisition Procedure," KM Europa Metal, SMI Group, Germany.

*Ecowave®*, "The ecological," KM Europa Metal AG, Bar Division, Miraustrasse 10–14, D–13509 Berlin, Germany.

*Ecowave®*, "Brass—protecting your drinking water," KM Europa Metal AG, Germany.

* cited by examiner

*Primary Examiner*—Sharidan Carrillo
(74) *Attorney, Agent, or Firm*—Barnes & Thornburg

(57) ABSTRACT

Brass articles having leachable lead are contacted with an aqueous caustic solution having a pH of about 10 to about 14 that contains a chelating agent. During contact, the brass articles can be sonicated. The brass articles can be optionally pretreated by contacting them with an aqueous solution containing an organic carboxylic acid and an inorganic per-salt. The brass article can optionally further be post treated by contacting them with an aqueous solution containing thiourea.

15 Claims, No Drawings

METHOD FOR TREATING BRASS

TECHNICAL FIELD

The present invention relates to a process for treating brass. More particularly, the present invention is directed to a process of removing lead from the surface of brass fixtures.

BACKGROUND ART

Brass is an alloy composed principally of copper, tin zinc and lead. The amount of lead added to brass affects its strength, workability and machinability of the final alloy. Brass has been widely used for plumbing fittings, waterworks valves and fittings, bronze alloys and a host of other applications. Perhaps the most widespread application of brass is its use in the manufacture of faucets, valves, fittings, water meters, and related products intended for use in delivering potable water to and within commercial or residential sites. For such uses, the amount of lead that is required to affect the desired strength machinability of the brass causes concerns with the leachability of the lead into the environment where such faucets, valves, fittings and related products are used.

Lead exhibits a relatively low solubility in solid solution in brass alloys due to the atomic size of lead atoms which is larger than copper or zinc. The low solubility of lead in brass alloys causes the lead to precipitate in lead-rich regions dispersed throughout brass alloys. The tendency toward precipitation is particularly notable near the surface of brass articles. In addition to improving the machinability of brass adjacent to the surface, the precipitation of lead near the surface increases the tendency of lead present on the surface to leach into water.

Recent standards have significantly limited the acceptable amount of lead that can be leached from brass faucets, valves, fittings and related products. One such example is the Safe Drinking Water Act, amended in 1988 to limit lead in solders and fluxes to 0.2% and to limit lead in public water supply pipes and fittings to 8%.

Similarly, efforts have been underway to limit the amount of lead found in food or water. California, for example, has promulgated regulations limiting lead exposure of an individual to less than 0.5 micrograms per day. On the Federal level, the EPA, in 1991, restructured the standard of lead in drinking water from 50 parts per billion to 15 parts per billion.

While the amount of lead that can be leached from brass plumbing components is generally low, it is nonetheless possible that the amount of lead that can be leached from such components may exceed current or planned standards. It has been proposed that current standards be made even more stringent so that lead is omitted totally from brass alloys or that brass articles be treated so that minimum quantities of lead may be leached from such articles.

Various techniques which have been proposed to minimize the leaching of lead into drinking water are exemplified by United States Patent Nos. 5,453,876 to Downey, 5,601,658 to Marinas et al., 5,707,421 to Joe, 5,904,783 to Hager et al., 5,919,519 to Tallis, and 5,958,257 to Regelbrugge et al. International Patent Publication No. WO 97/06313 also exemplifies a proposed technique to minimize the leaching of lead into drinking water.

The present invention provides a simple, relatively efficient process for treating brass which removes leachable lead therefrom.

DISCLOSURE OF THE INVENTION

According to other features, characteristics, embodiments and alternatives of the present invention which will become apparent as the description thereof proceeds below, the present invention provides a method of treating brass articles to reduce leachable lead therein which involves:

contacting a brass article with primary treatment solution comprising an aqueous caustic solution containing a chelating agent and having a pH of about 10 to about 14.

The present invention also provides a method of treating brass articles to reduce leachable lead therein which involves contacting a brass article with a primary treatment solution which comprises an aqueous caustic solution containing about 1 to about 10 weight percent of ethylenediaminetetraacetic acid and about 1 to about 20 weight percent of sodium hydroxide and having a pH of about 10 to about 14.

The present invention further provides solution for treating brass article to reduce leachable lead therein which includes:

an aqueous caustic solution containing a chelating agent and having a pH of about 10 to about 14.

BEST MODE CARRYING OUT THE INVENTION

The present invention is directed to a process of removing lead from brass and bronze articles. The present invention can be used to treat a variety of brass fixtures including faucets, valves, fittings and other brass and bronze articles.

The process of the present invention involves contacting brass articles to be treated with a high pH solution containing a chelating agent. The pH of the solution should be at least about 6 to 10, and preferably above 10.

According to theory, chelating agents possess acid-base characteristics and chelation is an equilibrium reaction. Accordingly, during the course of the present invention, the inventors found that using high pH solutions in conjunction with chelating agents improved the removal of lead from brass articles.

Accordingly, an amount of caustic should be included in the treatment solution which is sufficient to raise the pH of the solution to at least about 6 to 10, and preferably above 10.

A number of chelating agents including phosphonic acids and aminopolycarboxlic acids can be used according to the present invention. Particularly suitable chelating agents include ethylenediaminetetraacetic acid (EDTA), N-hydroxyethylethylenediaminetriacetic acid (HEDTA), and diethylenetriaminepentaacetic acid (DTPA), with ethylenediaminetetraacetic acid (EDTA) being particularly suitable for purposes of the present invention.

The pH of the treatment solution can be adjusted by adding a caustic material such as an alkali metal hydroxide, an alkali metal carbonate, or an alkali metal phosphate. Alkali metal hydroxides are particularly useful, with sodium hydroxide being suitable for purposes of the present invention.

The primary treatment solution thus comprises an aqueous solution of a caustic and chelating agent. After the primary treatment bath, treated brass articles should be subjected to a treatment rinse using water. For optimal rinsing, parts may be subjected to ultrasonics at 25kHz to 40kHz, or the bath can be agitated or caused to flow or circulate.

In addition to the primary treatment solution which is also referred to herein as the primary treatment bath, an optional pretreatment solution which comprises an aqueous bath containing an organic carboxylic acid and an inorganic per-salt such as ammonium persulphate, sodium persulphate, potassium persulphate, or sodium perborate can be used according to the present invention.

A typical pretreatment bath useful for purposes of the present invention comprises an aqueous solution containing citric acid and sodium persulfate.

When a pretreatment bath is used, treated brass articles should be subjected to a pretreatment rinse using water.

In addition to the optional pretreatment bath, brass articles processed by the present invention can also be subjected to a post treatment bath.

Brass articles that are treated with a caustic such as sodium hydroxide have an appearance that may not be acceptable in the brass fixture industry. The uneven brownish-black appearance produced during treatment in the primary treatment bath is believed to be due to a copper oxide layer. Although this discoloration may not be a factor in treating brass articles whose aesthetic appearance is unimportant, the appearance of discoloration on other brass articles such as faucets can be important.

A post treatment bath containing thiourea was determined to reduce the metal oxide present on the brass parts that were darkened by the primary treatment bath. A thiourea post-treatment bath containing thiourea and ammonium chloride having a near neutral pH, e.g. about 6 was found to be particularly useful for purposes of the at present invention.

The following examples are presented to illustrate, but not limit, the invention as variations thereon will become obvious to those skilled in the art. In the examples and throughout percentages are by weight unless otherwise indicated.

EXAMPLE 1

In this Example brass couplings and 1½ inch brass check valves were treated with a caustic/EDTA bath and a caustic pretreatment bath to determine the effectiveness of the baths.

The brass parts were pretreated for 30 seconds in an aqueous solution containing 10% by weight of citric acid and 10% by weight of sodium persulfate. After the pretreatment bath, the parts were rinsed in deionized water.

The pretreated and rinsed brass parts were dipped for 15 minutes in either a caustic bath containing 5% by weight of sodium hydroxide or in a caustic/EDTA bath containing 5 by weight of sodium hydroxide and 1% by weight of EDTA. The parts were sonicated at either 25 kHz or 40 kHz during treatment. The treated parts were subsequently rinsed in deionized water.

It was determined that the caustic treatment bath that contained 1t by weight EDTA successfully extracted lead from the brass parts without leaving a metal oxide residue (as was the case for some coupons treated in the caustic bath). Generally, the mass of lead removed in the caustic bath was slightly higher than the caustic/EDTA bath. However, there was an increase in copper and zinc removed which raised concerns regarding treatment of used bath solutions. Also, the caustic bath had a tendency of depositing metal oxides on treated parts.

Lead leaching test showed that parts sonicated at 25 kHz released 30% more lead than parts sonicated at 40 kHz. It was determined that at 40 kHz a smaller amplitude sound wave is generated, subsequently causing smaller cavitation bubbles to contact the surface of the parts. The smaller bubbles are capable of navigating the crevasses of complex brass surfaces resulting in a more uniform surface lead removal. At 25 kHz the brass surface is more vigorously attacked, but not in a uniform manner.

All treated couplings regardless of treatment protocol passed the leach test of 5 ppb. The normalized lead concentration for each coupling result (average of three) was below 1 ppb.

Pretreatment of the parts with the caustic solution caused pitting of the surface brass and an increase in surface area. Total lead released to the caustic/EDTA treatment was slightly elevated (approximately 7%) for pretreated parts in comparison to unpretreated parts at 40 kHz. The unpretreated couplings showed a marked increase in soluble lead (ranging from 30%–110%) over the pretreated parts during lead leaching testing.

EXAMPLE 2

Brass articles that are treated with sodium hydroxide have an appearance that is not acceptable in the brass fixture industry. The uneven brownish-black appearance produced during treatment in the primary treatment bath is believed to be a copper oxide layer. In this Example formulations for a post treatment bath that would restore the brass appearance without compromising the leachable lead content that was reduced by the primary treatment bath were evaluated.

Initially a thiourea post treatment bath that contained acid components (sulfamic acid and hydrogen chloride) was tested. This bath composition was found to create excessive effervescing of the brass articles due to hydrogen gas that evolved as the acid dissolved the brass, exposing a fresh layer of lead. Such newly exposed lead was determined to be susceptible of further leaching. Accordingly, it was decided to remove the acid components from the post treatment bath.

As a result of experimental testing, a post treatment bath containing about 5% thiourea and 6.25% ammonium chloride which had a pH of about 6.0 was determined to reduce the metal oxide layer present on brass articles. Moreover, it was determined that the thiourea treatment was not aggressive enough to cause a significant amount of copper to be removed and thus expose fresh lead on the surface of the articles.

EXAMPLE 3

Having established that smaller brass parts could be effectively pretreated with an aqueous solution containing citric acid and sodium persulfate, followed by treatment in a caustic solution containing EDTA while subjected to 40 kHz ultrasonics, further testing was conducted to determine whether this treatment scheme could be used to treat an array of brass articles, including larger brass parts.

In this Example, eight different articles having a total combined weight of about 30.5 pounds were treated to mimic conditions for a full scale treatment operation. Information on each article is provided in Table 1 as follows:

TABLE 1

| Part Letter | Part Name | Weight (lbs.) | Internal Volume (liters) |
|---|---|---|---|
| A | ¾" Key Meter Valve | 1.7 | 0.023 |
| B | ¾" Ball Meter Valve | 2.0 | 0.024 |
| C | ¾" Check Valve | 1.3 | 0.051 |
| D | 1" Ball Meter Valve | 3.1 | 0.032 |
| E | ¾" Ball Valve Curb Stop | 1.9 | 0.022 |

TABLE 1-continued

| Part Letter | Part Name | Weight (lbs.) | Internal Volume (liters) |
|---|---|---|---|
| F | 1" Pack Joint Nut | 2.7 | 0.088 |
| G | 2" Angle Meter Valve | 9.4 | 0.22 |
| H | 2" Ball valve Curb Stop | 8.4 | 0.25 |

In this Example, all the parts were pretreated for 30 seconds in a 10% citric acid and 10% sodium persulfate bath. Following pretreatment, the parts were rinsed in 4 groups (A B C; D E F; G and H). Each group was rinsed in a separate 3 liter deionized water bath.

Following a pretreatment rinse, all 8 parts were treated consecutively (A through H) in a 16.2 liter caustic/EDTA bath (5% NaOH, 1% EDTA) for 30 minutes each. The parts were sonicated at 4kHz during treatment. Following treatment, each part was rinsed in a separate 3 liter deionized water bath.

The Effectiveness of treatment was determined from measurements of the release of copper, lead and zinc to both the treatment and rinse baths calculated as an average with treatment bath age. These results of the loss of lead are shown in Table 2.

TABLE 2

| | Treatment Bath (mg) | | | Rinse Bath (mg) | | |
|---|---|---|---|---|---|---|
| Part | Pb/part | Pb/lb Actual | Pb/lb Average | Pb/part | Pb/lb Actual | Pb/lb Average |
| A | 145.90 | 85.83 | 85.83 | 0.27 | 0.16 | 0.23 |
| B | 134.14 | 67.07 | 75.69 | 0.31 | 0.16 | 0.23 |
| C | 263.25 | 202.50 | 108.66 | 1.95 | 1.50 | 0.23 |
| D | 228.74 | 73.79 | 95.31 | 1.74 | 0.56 | 0.23 |
| E | 217.73 | 114.59 | 98.98 | 1.56 | 0.82 | 0.23 |
| F | 258.23 | 95.64 | 98.27 | 3.15 | 1.17 | 0.23 |
| G | 362.23 | 38.54 | 72.86 | 6.36 | 0.68 | 0.23 |
| H | 903.47 | 107.56 | 82.42 | 16.69 | 1.99 | 0.23 |

Table 3 lists the average loss of lead, copper and zinc.

TABLE 3

| Metal | Average Metal Removed (mg. metal/lb. brass) |
|---|---|
| Lead | 82.4 |
| Copper | 13.1 |
| Zinc | 2.7 |

The results of this Example show that the treatment bath experienced only minor degradation over time. Generally, the average lead removal per pound brass treated stayed relatively constant and total lead removal tended to increase with increased weight and internal volume. When the weight of each part is factored into the removal efficiency, the lead removed per pound decreases.

All eight parts easily passed the leach test target limit of 5 ppb (normalized) lead. In fact all parts, with the exception of the 2-inch Angle Meter Valve, leached lead below 1 ppb during a 17 day leach test conducted at pH 10.

The results of this Example proved that the treatment protocol developed for smaller brass parts was applicable to an array of parts, ranging in size and shape.

From tests performed, it was determined that 12000 lbs. of brass parts can be treated on a daily basis using 234 lbs. of caustic (NaOH), 47 lbs. of sodium EDTA, 87 lbs. of citric acid and 87 lbs. of sodium persulfate.

In this Example nine 2 inch check valves weighing each were consecutively pretreated for 30 seconds in a single 5 liter aqueous bath containing 10% citric acid 10% sodium persulfate. Following pretreatment, each check valve was rinsed in a separate 3 liter bath of deionized water.

Each check valve was then consecutively treated in a 16.2 liter caustic/EDTA bath (5% NaOH, 1% EDTA) for the following time increments 20, 40, 60, 60, 40, 20 40, 60, and 20 minutes while undergoing sonication at 40kHz. Following treatment, each check valve was rinsed in a separate 3 liter deionized water bath for 5 minutes.

Total metal removed was calculated from samples of the treatment bath and subsequent rinse bath. These values which are given as mg. metal/lb. brass are listed in 4.

TABLE 4

| Treatment Duration (min) | Lead | Copper | Zinc |
|---|---|---|---|
| 20 | 64.5 | 10.7 | 2.2 |
| 40 | 92.7 | 12.6 | 2.9 |
| 60 | 77.9 | 12.1 | 2.7 |

The average mass of metal removed per pound of brass (mg./lb.) treated was comparable to the average in Example 3 above, as shown in Table 5.

TABLE 5

| Metal | Array of Parts (Ex. 3) | 2" Check Valves | % Increase |
|---|---|---|---|
| Lead | 82.4 | 92.7 | 12% |
| Copper | 13.1 | 12.6 | −4% |
| Zinc | 2.7 | 2.9 | 7% |

As can be seen, the average mass of metal removed per pound of brass treated was comparable to the average calculated from the array of parts in Example 3. Although the majority of the 2 inch check valves treated for 20 or 60 minutes did not pass the leach test for lead, the check valves treated for 40 minutes were either below the target limit of 5 ppb (normalized) lead or within the range of the target limit. Parts treated for 20 or 60 minutes were consistently above the limit.

Upon review of bath kinetics, it was determined that the bath was spent after approximately 3 check valves were treated. After treatment of 3 check valves the copper concentration approached its maximum of 25 mg/L in solution, above which metal oxide plating occurred. It was determined that an increase in EDTA for check valves treated for 40 minutes would likely produce parts able to pass regulatory standards for lead.

EXAMPLE 5

In this Example a 1 ½ inch check valve weighing 6.9 lbs. was pretreated for 30 seconds in a 5 liter aqueous bath containing 10% citric acid 10% sodium persulfate. Following pretreatment, the check valve was rinsed in a 3 liter bath of deionized water.

The check valve was then treated in a 16.2 liter caustic/EDTA bath (5% NaOH, 1% EDTA) for 30 minutes while undergoing sonication at 40kHz. Following treatment, the check valve was rinsed in a 3 liter deionized water bath for 5 minutes.

Total metal removed was calculated from samples of the treatment bath and subsequent rinse bath. These values which are given as mg. metal/lb. brass are listed in Table 6.

TABLE 6

| Metal | lbs. Metal/lbs. Brass Treated |
|---|---|
| Lead | 79.2 |
| Copper | 18.0 |
| Zinc | 0.1 |

The lead removal in this Example is comparable to the average lead removal calculated in Example 3 above. The mass of the copper increased and the mass of the zinc decreased in comparison to the results in Example 3.

The leach test results show that the 1 M inch check valve easily passed the target leach test for lead at pH 10.

The majority of brass parts tested during the course of the present invention pass leach tests for lead when at least 79 mg lead were removed per pound of part treated. The 2-inch check valve was the only brass part that did not follow this trend. The 2-inch check valve was one of the larger parts tested. In addition, the 2-inch check valve has a sizable amount of surface that is unmachined. It was determined during the course of the present invention that machined surfaces of brass parts were more susceptible to treatment than non-machined surfaces. In order to more effectively treat 2-inch check valves, it was determined that such parts could be rotated in order to more thoroughly expose all surface areas. Otherwise, the treatment baths could be agitated or flowed in order to better reach all surface areas and introduce fresh bath to the surfaces.

Based upon the tests performed during the course of the present invention, it was determined that it was possible to treat brass articles so as to remove lead therefrom, to the extent that the brass articles would pass the lead leach test target of 5 ppb (normalized) lead.

The primary treatment bath can contain about 1 to about 10 weight percent of one of the chelating agents mentioned above and about 1 to about 20 weight percent of one of the caustic components mentioned above. An illustrative treatment bath referred to in the Examples above includes about 1 weight percent of EDTA and about 5 weight percent sodium hydroxide. The pH of the primary treatment bath should be at least about 10 to about 14.

The brass articles to be treated can be contacted by the primary treatment bath by dipping, immersing, continuous spraying or any procedure which results in contacting the articles with the bath. When the brass articles are dipped or immersed into the primary treatment bath they should be in contact with the bath for about 10 to about 60 minutes, and ideally for about 15 to about 40 minutes. Treatment times of about 30 minutes were found to be generally suitable for purposes of the present invention.

When dipped or immersed in a primary treatment bath, the brass articles can be sonicated at about 25 kHz to about 40 kHz. In addition or alternatively, the primary treatment bath can be agitated or caused to flow or circulate.

An optional pretreatment bath can be used in conjunction with the primary treatment bath. A suitable pretreatment bath can include about 1 to about 30 weight percent of an organic carboxylic acid and about 1 to about 30 weight percent of an inorganic per-salt. An illustrative pretreatment bath referred to in the Examples above includes about 10 weight percent citric acid and about 10 weight percent of sodium persulfate. The brass articles can be contacted with the pretreatment bath in the same manner as they are contacted with the primary treatment bath. The brass articles can be contacted with the pretreatment bath for about 0.01 to about 5 minutes.

When dipped or immersed in a pretreatment bath, the bath can be agitated or caused to flow or circulate. In addition or alternatively, the pretreatment bath can be agitated or caused to flow or circulate. The brass articles should be rinsed after treatment in the pretreatment bath and before treatment in the primary treatment bath in order to prevent contamination of the primary treatment bath.

Treatment of the brass articles in the primary treatment bath and the optional pretreatment bath will effectively remove leachable lead therefrom. If the resulting surface appearance of the brass articles is unacceptably oxidized, the parts can be further treated by contacting them in a post treatment bath that contains about 5 to about 10 weight percent of thiourea and about 1 to about 10 weight percent of ammonium chloride.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed is:

1. A method of treating brass articles to reduce leachable lead therein which comprises the steps of: contacting a brass article with primary treatment solution to reduce leachable lead therein, the primary treatment solution having pH of about 10 to about 14 and comprising an aqueous caustic solution containing a chelating agent; and contacting the brass article with a pretreatment solution prior to being contacted with the primary treatment solution, said pretreatment solution comprising an aqueous solution containing an organic carboxylic acid and an inorganic per-salt.

2. A method of treating brass articles to reduce leachable lead therein according to claim 1, wherein the chelating agent is selected from the group consisting of phosphonic acids, aminopolycarboxlic acid and mixtures thereof.

3. A method of treating brass articles to reduce leachable lead therein according to claim 1, wherein the chelating agent is selected from the group consisting of ethylenediaminetetraacetic acid, N-hydroxyethylethylenediaminetriacetic acid, diethylenetriaminepentaacetic acid and mixtures thereof.

4. A method of treating brass articles to reduce leachable lead therein according to claim 1, wherein the caustic solution includes a caustic component selected from the group consisting of an alkali metal hydroxide, an alkali metal carbonate, an alkali metal phosphate and mixtures thereof.

5. A method of treating brass articles to reduce leachable lead therein according to claim 1, wherein the brass article is sonicated during contact with the primary treatment solution.

6. A method of treating brass articles to reduce leachable lead therein according to claim 1, wherein the inorganic per-salt is selected from the group consisting of ammonium persulphate, sodium persulphate, potassium persulphate, sodium perborate and mixtures thereof.

7. A method of treating brass articles to reduce leachable lead therein according to claim 1, wherein the brass article is sonicated during contact with the pretreatment solution.

8. A method of treating brass articles to reduce leachable lead therein according to claim 1, wherein the brass article is contacted with a post treatment solution after being contacted with the primary treatment solution, said post treatment solution comprising an aqueous solution containing thiourea.

9. A method of treating brass articles to reduce leachable lead therein according to claim 1, wherein the brass article is selected from the group consisting of faucets, valves and fittings.

10. A method of treating brass articles to reduce leachable lead therein according to claim 8, wherein the post treatment solution further contains ammonium chloride.

11. A method of treating brass articles to reduce leachable lead therein which comprises the steps of contacting a brass article with a primary treatment solution to reduce the leachable lead, the primary treatment solution having a pH of about 10 to about 14 and comprising an aqueous caustic solution containing about 1 to about 10 weight percent of ethylenediaminetetraacetic acid and about 1 to about 20 weight percent of sodium hydroxide; and contacting the brass article with a post treatment solution after being contacted with the primary treatment solution, said post treatment solution comprising an aqueous solution containing about 5 to about 10 weight percent of thiourea and about 1 to about 10 weight percent of ammonium chloride and having a pH of about 6 to about 8.

12. A method of treating brass articles to reduce leachable lead therein according to claim 11, wherein the brass article is contacted with a pretreatment solution prior to being contacted with the primary treatment solution, said pretreatment solution comprising an aqueous solution containing about 1 to about 30 weight percent of citric acid and about 1 to about 30 weight percent of sodium persulfate.

13. A method of treating brass articles to reduce leachable lead therefrom according to claim 11, wherein the brass article is selected from the group consisting of faucets, valves and fittings.

14. A method of treating brass articles to reduce leachable lead therefrom according to claim 11, wherein the brass article is sonicated during contact with the primary treatment solution.

15. A method of creating brass articles to reduce leachable lead therefrom according to claim 12, wherein the brass article is sonicated during contact with both the pretreatment solution and the primary treatment solution.

* * * * *